US007101019B2

(12) United States Patent
Inoue et al.

(10) Patent No.: US 7,101,019 B2
(45) Date of Patent: Sep. 5, 2006

(54) RECORDING APPARATUS

(75) Inventors: Hiroyuki Inoue, Kanagawa (JP); Shusuke Inamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 272 days.

(21) Appl. No.: 10/765,036

(22) Filed: Jan. 28, 2004

(65) Prior Publication Data

US 2004/0183858 A1 Sep. 23, 2004

(30) Foreign Application Priority Data

Jan. 31, 2003 (JP) ..... 2003-024042

(51) Int. Cl.
*B41J 23/00* (2006.01)
*B41J 2/14* (2006.01)

(52) U.S. Cl. ..... 347/37; 347/50

(58) Field of Classification Search ..... 347/37, 347/50; 400/352

See application file for complete search history.

(56) References Cited

U.S. PATENT DOCUMENTS 5,619,237 A 4/1997 Inoue et al.
5,867,188 A * 2/1999 Murayama et al. ..... 347/37
5,971,525 A 10/1999 Inoue et al.
6,733,317 B1 5/2004 Sato

FOREIGN PATENT DOCUMENTS

| | | |
|---|---|---|
| JP | 4-235040 | 8/1992 |
| JP | 10-181007 | 7/1998 |
| JP | 2002-254752 | 9/2002 |

* cited by examiner

*Primary Examiner*—Lamson Nguyen
*Assistant Examiner*—Jannelle M. Lebron
(74) *Attorney, Agent, or Firm*—Fitzpatrick, Cella, Harper & Scinto

(57) ABSTRACT

A recording apparatus includes a miniaturized carriage. When a recording head is mounted, a head side connecting portion to which electric power for driving the recording head and a signal are transmitted and a card edge connector of a head holding member are electrically connected to each other. The recording head is detachably attachable to the head holding member by rotation of a lever member. A pressing portion for pressing the recording head in a connector insertion direction of a connecting portion is arranged near a rotational center of the lever member. Due to the above configuration, a miniaturized carriage can be formed while the card edge connector is used, fixation and release of the recording head can be stably realized, and the miniaturization of the recording apparatus itself can be realized.

7 Claims, 8 Drawing Sheets

RECORDING APPARATUS

BACKGROUND OF THE INVENTION

1. Field of the Invention

The present invention relates to a recording apparatus.

2. Related Background Art

Conventionally, in the recording apparatus in which recording is performed to a recording medium such as paper or an OHP sheet, various modes in which recording heads adopting various recording methods are mounted have been proposed. A wire dot printing method, a thermal printing method, a heat transfer printing method, and an inkjet printing method can be cited as examples of the recording head.

Particularly, the inkjet printing method in which ink is directly ejected to the recording medium is widely used compared with other methods, because an operating noise level is low during recording operation and running cost is low.

In the inkjet recording apparatus, performance such as colorization of characters and patterns (or graphics) to be recorded, speed-enhancement of recording operation, or quality-enhancement of recording image has been remarkably improved. The inkjet recording apparatus becomes familiar to users more and more, such that the inkjet recording apparatus is placed on an individual desk in an office or the inkjet recording apparatus is used on daily basis in home. Therefore, in the inkjet recording apparatus, user requests for further miniaturization and weight reduction while maintaining the high performance are increased. In particular, reduction of the thickness of the inkjet recording apparatus is strongly desired so that the inkjet recording apparatus can be stored in a bookshelf or a drawer of the desk while the user does not use the inkjet recording apparatus.

In the so-called serial type recording apparatus in which the recording is performed while the recording head is scanned, the miniaturization of the recording head is very efficient to the miniaturization of the inkjet recording apparatus and the reduction of the thickness of the inkjet recording apparatus. Because the serial type recording apparatus has a structure which requires a space in which the recording head is fully scanned within a recording width in the apparatus, the scanning space becomes smaller as the scanning head is smaller. Accordingly, the space which is more than the space obtained by the miniaturization of the recording head can be decreased.

However, even if the recording head is miniaturized, the advantage of the miniaturization of the recording head is lessened when a carriage mounting the recording head and peripheral parts of the carriage, i.e., the portion which is scanned with the recording head, cannot be miniaturized.

From the point of view of maintenance, the recording head generally has a configuration in which the recording head is detachably attachable to the carriage. In the detachably attachable type recording head, a configuration for fixing the recording head on the carriage is provided. In many cases, it is necessary to adopt the configuration which is easily operated by a user, in order that the user can exchange the recording heads. Therefore, a relatively large operating lever is conventionally provided in order to fix the recording head to the carriage. Further, a connector which connects the recording head and a cable for supplying a recording signal or electric power to the recording head is also required for the carriage. For example, in Japanese Patent Application Laid-Open No. H04-235040, there are disclosed a mounting portion for mounting the recording head on the carriage and a lever member displacably provided so as to cover the recording head mounting portion, wherein connection or release of the connector is performed so that the connector is caused to come into contact with the mounted recording head and to separate from the mounted recording head by rotating the lever member.

In Japanese Patent Application Laid-Open No. H10-181007, there is also disclosed a smaller recording head detachably attachable mechanism. In this example, one sidewall of the carriage has a recording head locating portion and a pressure contact connector utilizing elastic force of a rubber pad, and the locating of the recording head and the connection of the connector are performed by rotationally inserting the recording head from obliquely upward toward one sidewall. Further, the recording head is securely fixed to the carriage in such a manner that a latch lever, which is rotatably provided in the other sidewall opposite to one sidewall, latches the recording head. Accordingly, the recording head can be accurately and securely located in the carriage with the simple operation or the simple mechanism.

The method of mounting a card edge connector on the carriage has been also proposed as one of the methods of miniaturizing the recording head and the carriage.

However, in the conventional example disclosed in Japanese Patent Application Laid-Open No. H04-235040, since the connector is moved to be connected to the recording head by the lever operation, it is required that there is a space for moving the connector as well as hard wirings or a board on which the connector is mounted. Accordingly, sometimes the apparatus was enlarged and the apparatus was not suitable for the miniaturization.

The conventional example disclosed in Japanese Patent Application Laid-Open No. H10-181007 has the configuration, in which the pressure contact connector utilizing the elastic force of the rubber pad is used and a reaction force of the connector is received by a structure of the carriage itself. In recent years, as the number of nozzles of the recording head is increased, the number of contact points of the connector tends to be increased. When the larger number of contact points of the connector is provided, in order to permit the reaction force, it is necessary to strengthen the structure of the carriage itself, and the apparatus tends to be enlarged. In order to solve the above problem, there is the method in which the card edge connector is adopted. However, in the conventional example disclosed in Japanese Patent Application Laid-Open No. H10-181007, since the fixation of the carriage and the connection of the connector are performed by the rotational operation of the recording head, there is the problem that the card edge connector cannot be used.

When the card edge connector is adopted, although the card edge connector itself is small, there is also the problem that the configuration for connecting and releasing the card edge connector results in the enlargement of the carriage.

SUMMARY OF THE INVENTION

It is an object of the invention to provide a recording apparatus which includes a miniaturized carriage.

It is another object of the invention to provide a recording apparatus comprising a head holding member which detachably mounts a recording head including a head side connecting portion to which electric power for driving the recording head and a signal are transmitted, the head holding member including a card edge connector where the head side connecting portion is inserted for electric connection when the recording head is mounted, a lever member which is arranged in the head holding member, the lever member inserting the recording head into the head holding member and detaching the recording head from the head holding member, by rotation of the lever member, and a recording head pressing portion which is arranged in the lever member, the recording head pressing portion pressing the recording head in a direction in which the head side connecting portion is inserted into the card edge connector, wherein the recording head pressing portion is arranged near a rotational center of the lever member.

DETAILED DESCRIPTION OF THE PREFERRED EMBODIMENTS

Preferred embodiments of the invention will be described below referring to the accompanying drawings.

Figure 1:
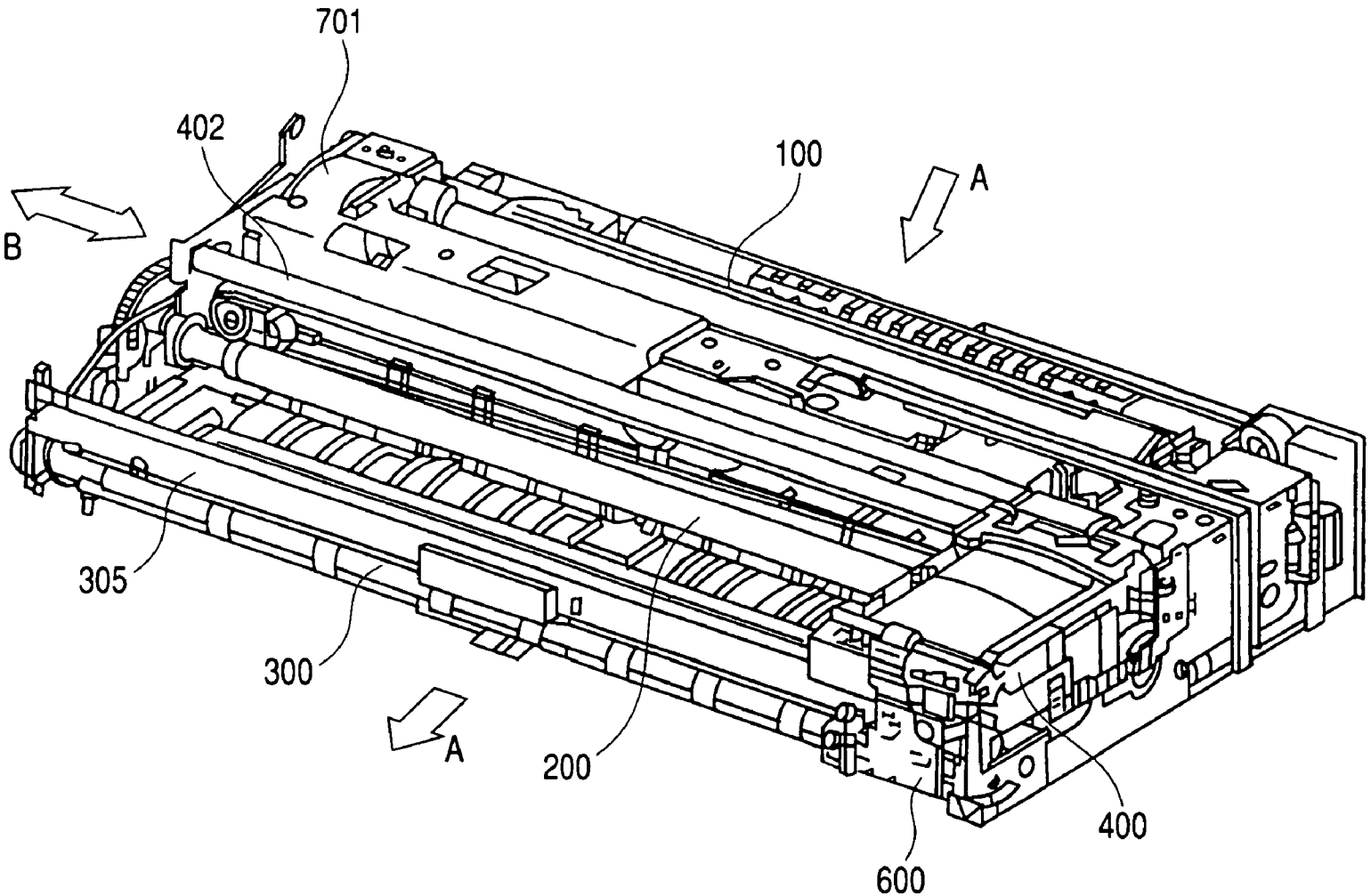
FIG. 1 is a perspective view showing a whole of a recording operation mechanism of a recording apparatus according to an embodiment of the invention.

FIG. 1 is a perspective view showing a whole of a recording operation mechanism of the recording apparatus according to the embodiment while an outer sheath of the recording apparatus is removed.

Broadly speaking, the recording operation mechanism in the embodiment includes an auto paper feed unit 100 which automatically feeds a recording paper P (not shown, a recording medium including a recordable flexible sheet such as a plastic sheet) to a transport unit 200 in a main body of the recording apparatus, the transport unit 200 which guides the recording paper P sent out one by one from the auto paper feed unit 100 to a desired recording position and ejects the recording paper P from the recording position, an ejecting unit 300 which is located on a downstream side from the transport unit 200, a recording unit 400 which performs desired recording on the recording paper P sent to the transport unit 200, and a recovery unit 600 which performs recovering processing to the recording unit 400 and the like. All the units of the recording operation mechanism are substantially unitarily formed around a chassis 701. A direction of feeding the recording paper P is indicated by an arrow A, and a reciprocating operation direction is indicated by an arrow B.

The recording unit 400 includes a guide shaft 402 and a carriage 401 which is movably supported by a guide rail 305. A recording head cartridge 501 is detachably mounted on the carriage 401.

Figure 2:
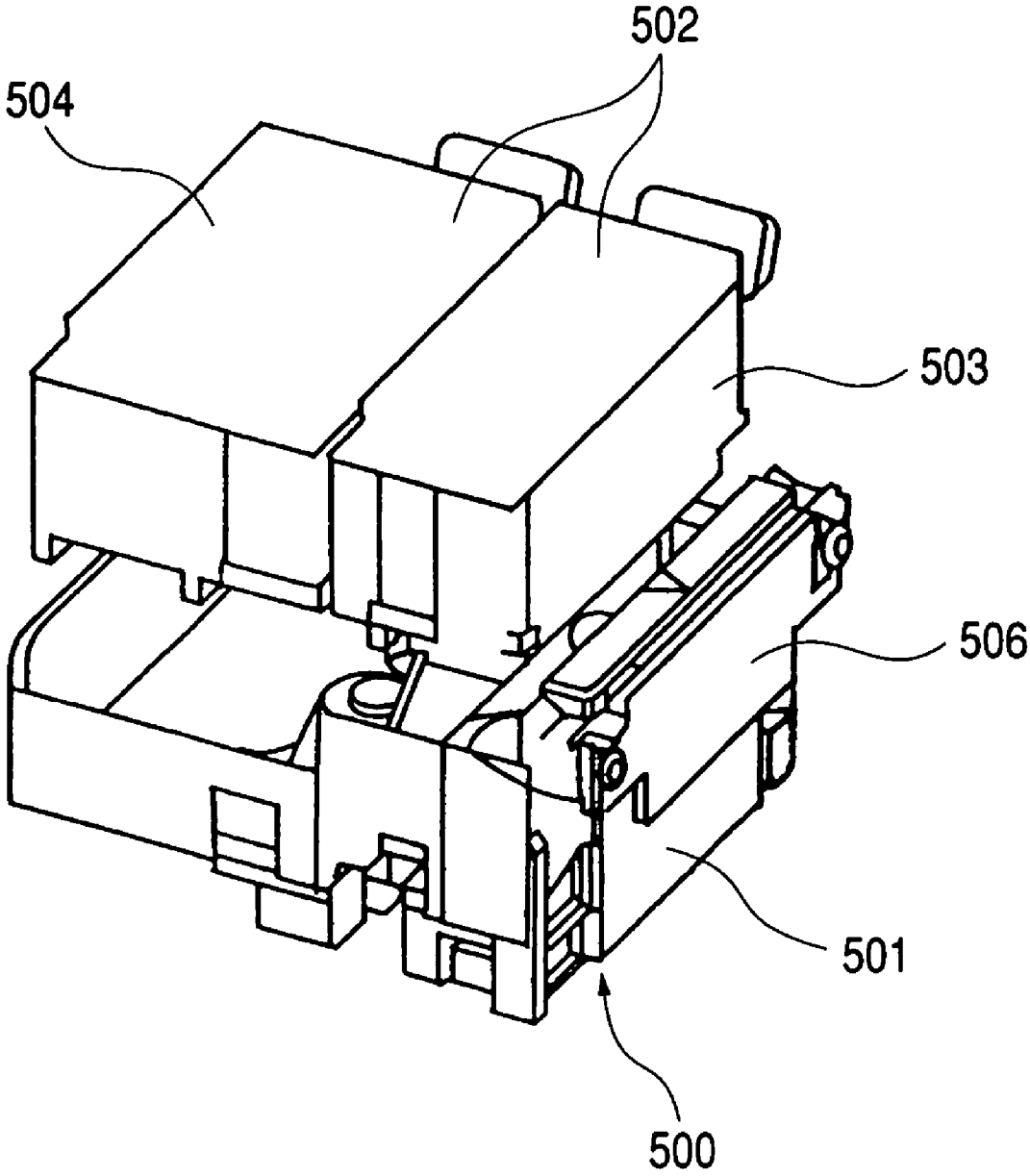
FIG. 2 is a perspective view of an external appearance of a recording head and an ink tank.

A recording head 500 in the embodiment will be described below referring to FIG. 2. An ink tank 502 which stores ink inside is detachably mounted on a recording head cartridge 501, and the recording head cartridge 501 has recording nozzles (not shown) which eject the ink supplied from the ink tank 502 according to recording information. The recording head cartridge 501 is of a so-called cartridge type in which the recording head cartridge 501 is detachably mounted onto the later-mentioned carriage 401.

In the recording head cartridge 501, a black ink tank 503 and a color ink tank 504 are prepared for the ink tank 502, in order that color printing can be performed. A cyan ink tank, a magenta ink tank, and a yellow ink tank are integrally formed in the color ink tank 504. The black ink tank 503 and the color ink tank 504 are detachable to the recording head cartridge 501, respectively.

The recording head cartridge 501 also includes an electric wiring board 506 which transmits a drive signal to the recording head 500.

Figure 3:
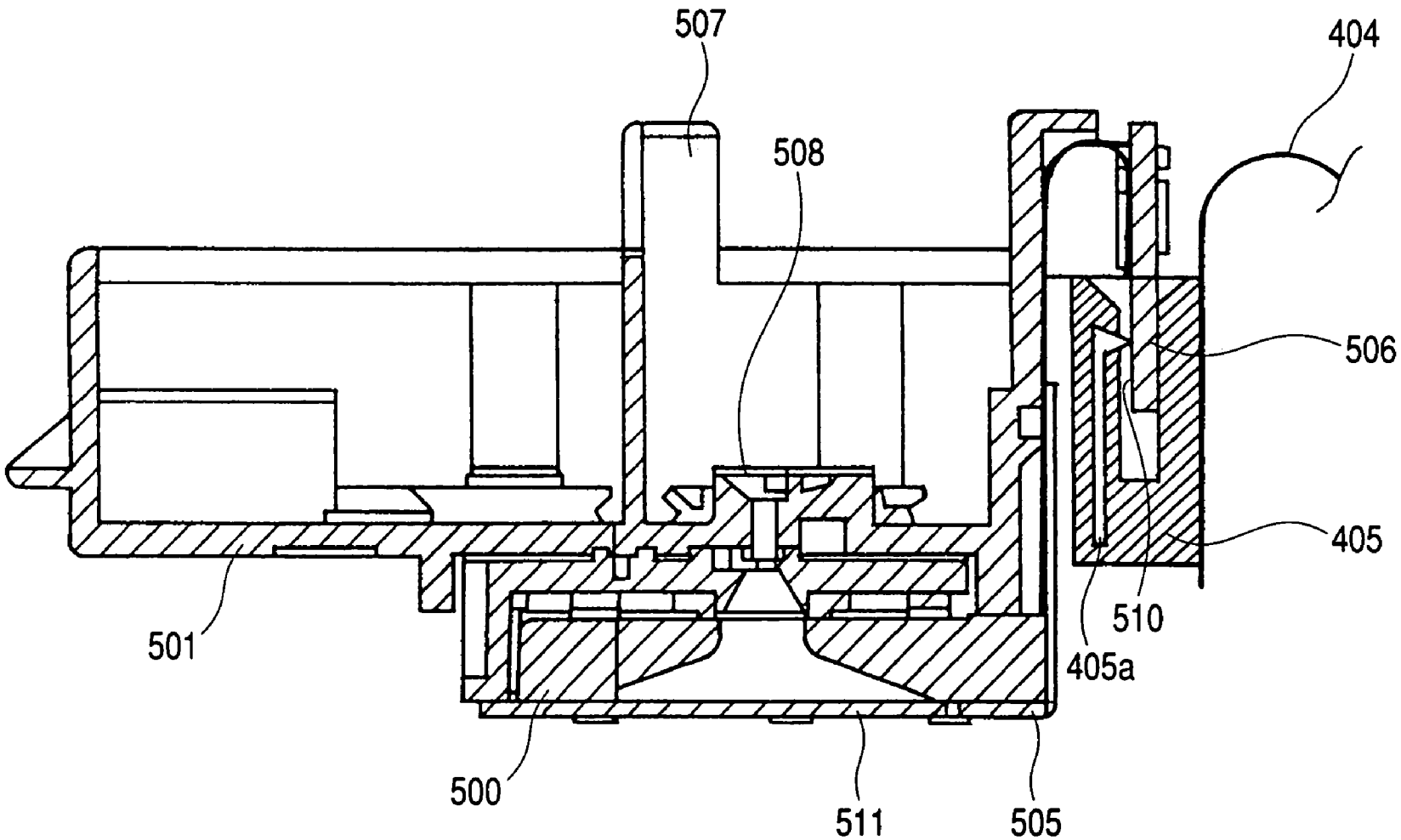
FIG. 3 is a sectional side view showing a connection state of the recording head and a card edge connector.

FIG. 3 shows a state in which the recording head 500 is fitted with a head connector 405 provided in the carriage 401 (not shown in FIG. 3).

The head connector 405 is electrically connected to the recording head 500 in such a manner that a contact pin 405*a* is fitted with an external input signal terminal 510 provided in the electric wiring board 506 of the recording head cartridge 501. The head connector 405 can transmit and receive various kinds of information for recording or supply electric power to the recording head 500. Further, the head connector 405 is held to be relatively movable to the carriage 401 so as not to block the recording head cartridge 501 and the carriage 401, when locating surfaces of the recording head cartridge 501 and the carriage 401 abut on each other and the recording head cartridge 501 and the carriage 401 are located with high accuracy.

A carriage FPC 404 is electrically connected to the head connector 405. The electric connection between the carriage FPC 404 and the head connector 405 can be held even if the head connector 405 is moved in locating the recording head cartridge 501.

Figure 4:
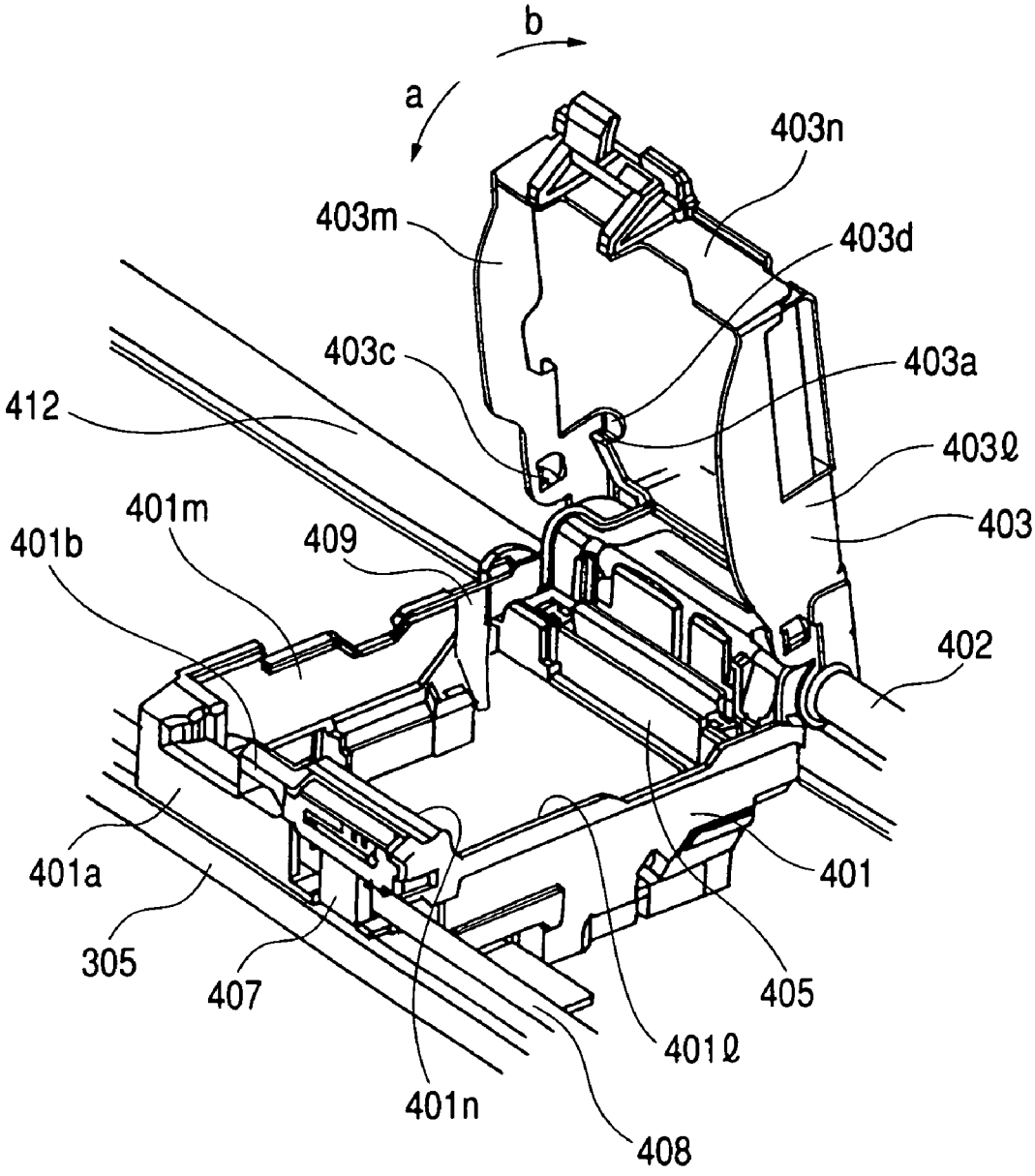
FIG. 4 is a perspective view showing a configuration of a carriage when a head set lever is opened.

FIG. 4 is a perspective view when a head set lever is opened. A head set lever 403 is provided in the carriage 401 while rotatably engaging the carriage 401. The head set lever 403 guides the recording head cartridge 501 to a loading position of the carriage 401 and presses the recording head cartridge 501 so as to set the recording head cartridge 501 to the predetermined loading position. The head set lever 403 is rotatably held so as to be substantially coaxial with the guide shaft 402 relative to the carriage 401.

When a user sets the recording head cartridge 501 to the carriage 401 and rotates the head set lever 403 in a direction of an arrow "a" shown in FIG. 4 until a latch click 406*c* of a head set hook 406 (see FIG. 8) engages with a latch engaging portion 401*b* of the carriage 401 (see FIG. 6), the locating surfaces of the recording head cartridge 501 and the carriage 401 abut on each other, the recording head cartridge 501 and the carriage 401 are located with high accuracy, and the mounting of the recording head cartridge 501 is completed.

When the recording head cartridge 501 is detached from the carriage 401, the user bends the latch of the head set hook 406 to release the engagement between the recording head cartridge 501 and the carriage 401 and rotates the head set lever 403 in the direction in which the head set lever 403 is opened (the direction of an arrow b shown in FIG. 4).

Figure 5:
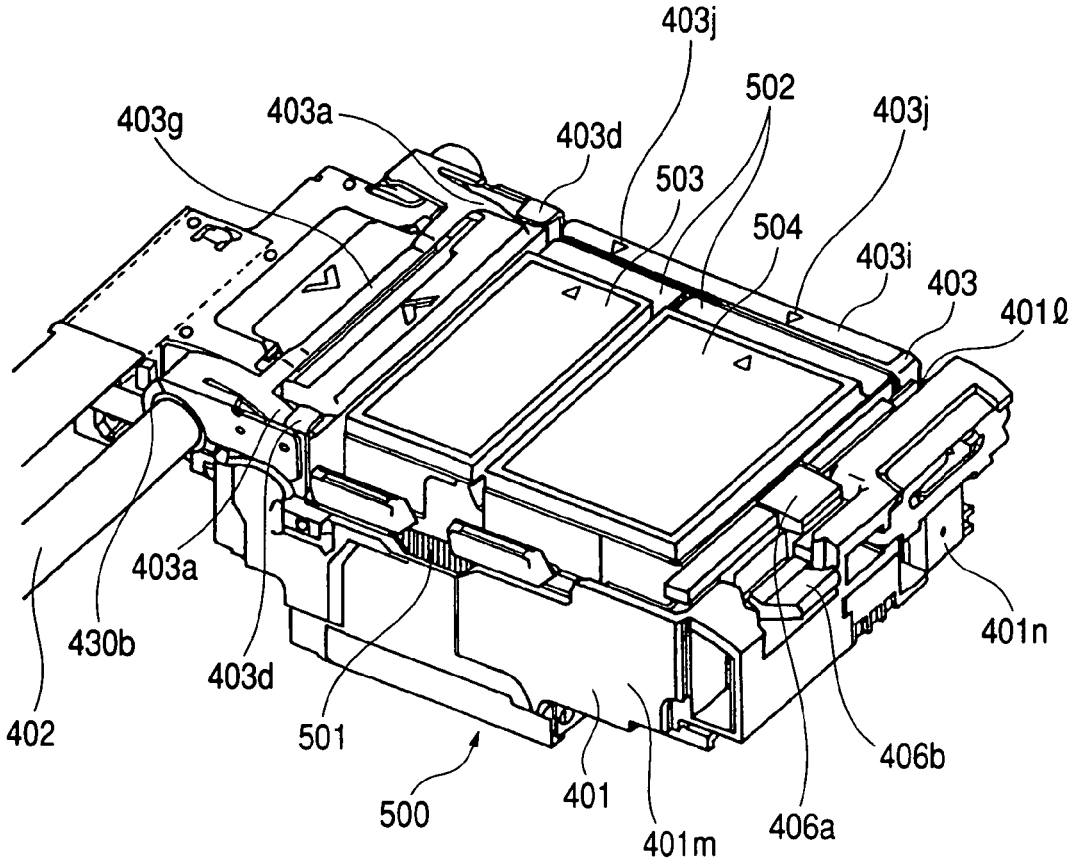
FIG. 5 is a perspective view showing the configuration of the carriage when the recording head is mounted.

FIG. 5 is a perspective view showing the state in which the recording head cartridge 501 is loaded or mounted in the carriage 401.

A manner in which the recording head cartridge 501 is fixedly mounted in the carriage 401 will be described in detail below referring to FIG. 4 and FIG. 5.

A hole through which the guide shaft 402 passes is made in the carriage 401. The hole forms a so-called bearing portion in which the carriage 401 slides along the guide shaft 402 when the carriage 401 scans. The bearing portion is provided on both the right and left sides of the carriage 401 respectively, so that the carriage 401 is supported at two points by the bearing. Bosses 430*a* and 430*b* are projected in the two bearing portions.

The head set lever 403 mainly includes a first side plate portion 403*l*, a second side plate portion 403*m*, and a front plate portion 403*n*. The head set lever 403 has a shape in which a sheet metal is formed in a U-shape. The head set lever 403 has a function of connecting the recording head cartridge 501 and the head connector by fixedly locating the recording head cartridge 501 to the carriage 401 by means of the rotational operation of the head set lever 403. The head set lever 403 also has the function of unfixing and releasing the recording head cartridge 501 from the head connector 405. The first side plate portion 403*l* and the second side plate portion 403*m* of the head set lever 403 have the holes which are fitted to the bosses 430*a* and 430*b* of the guide shaft bearing portions provided in the carriage 401, respectively. The head set lever 403 is fitted to the bosses 430*a* and 430*b* through the holes and supported by the guide shaft 402 while the head set lever 403 can be rotated about the guide shaft 402.

Recording head pressing portions (hereinafter referred to as pressing portion) 403*a* are symmetrically provided near a position where the head set lever 403 is fitted to the bosses 430*a* and 430*b*. The pressing portion 403*a* is formed by a metal sheet having elasticity. The pressing portion 403*a* has the function of pressing the recording head cartridge 501 onto the carriage 401. In the pressing portion 403*a* of the embodiment, the L-shape sheet metal material is fixed to the first side plate portion 403*l* and the second side plate portion 403*m* of the head set lever 403 by burring caulking. That is to say, the pressing portion 403*a* which is of a component different from the head set lever 403 is integrally fixed to the head set lever 403 by the burring caulking. This is because a degree of freedom in a spring thickness of the pressing portion 403*a* is increased. The spring thickness is required to obtain predetermined pressing force for pressing the recording head cartridge 501 to the carriage 401. Accordingly, in the embodiment, because the spring thickness obtaining the predetermined pressing force is different from the optimum thickness of the sheet metal constituting the whole of the head set lever 403, the pressing portion 403*a* is separately formed. Since the head pressing force is relatively large, the overall carriage will be enlarged if the sheet metal thickness of the overall head set lever is increased according to the spring thickness of the pressing portion 403*a*. In the present invention, such trouble can be prevented. It will be also appreciated that the head set lever 403 and the pressing portion 403*a* are integrally formed by the same sheet metal.

Figure 6:
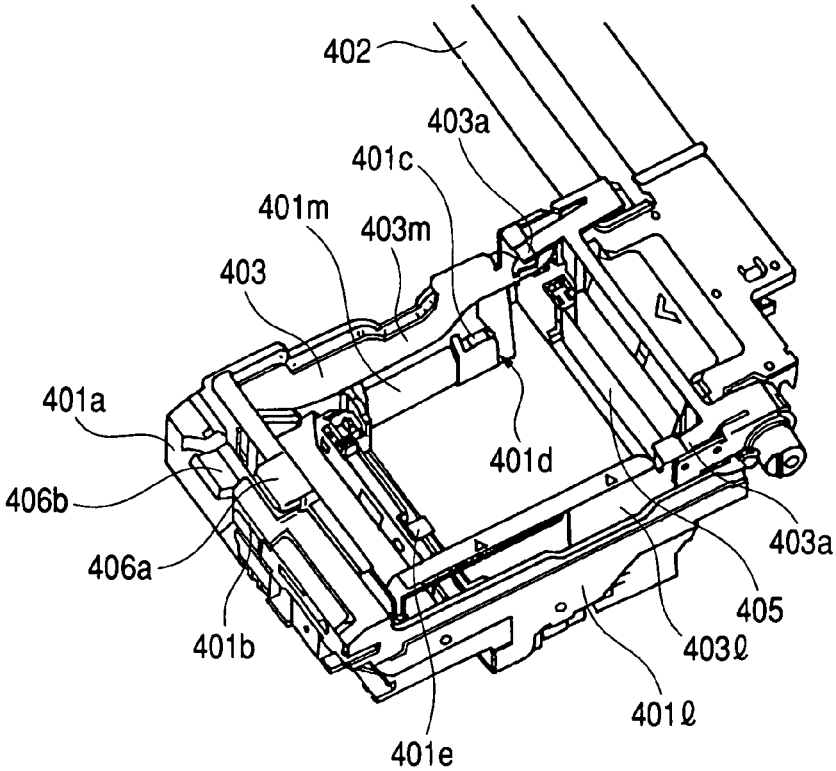
FIG. 6 is a perspective view showing the configuration of the carriage when a head set lever is closed.

The pressing portions 403*a* are provided near rotational supporting points which are of the center of the guide shaft 402, respectively. The rotational supporting points are provided on the right and left sides of the head set lever 403. As shown in FIG. 4 and FIG. 6, both end portions of the head connector 405 are located substantially directly below the pressing portions 403*a* provided on the right and left sides. Thus, the electric wiring board 506 is smoothly inserted into the head connector 405 by pressing the recording head cartridge 501 at the position near the both end portions of the head connector 405 from substantially directly above the head connector 405. A leverage of the head set lever 403 to the head set hook 406 can be secured by arranging the pressing portion 403*a* and the head connector 405 near the rotational center of the head set lever 403, so that the electric wiring board 506 can be fitted to the head connector 405 with lighter operating force.

Figure 7:
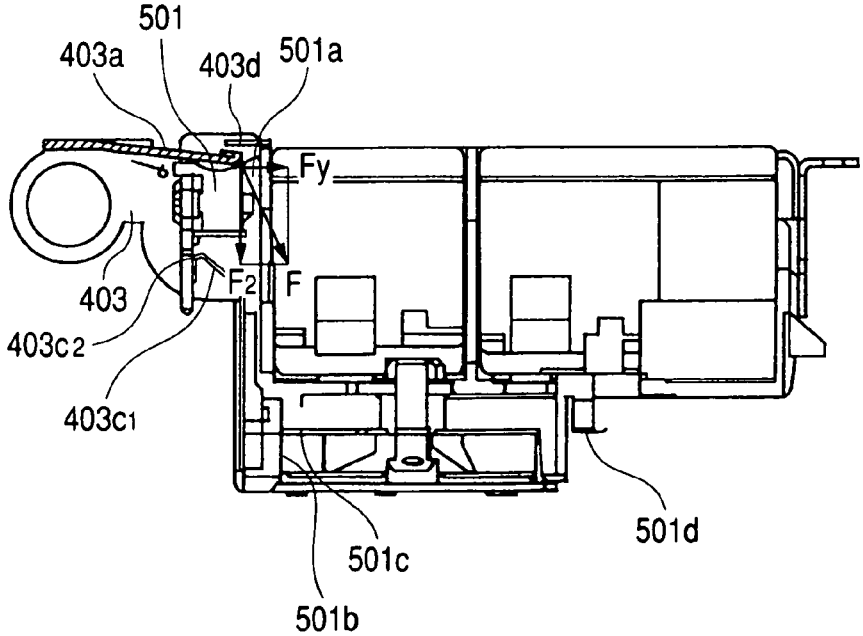
FIG. 7 is a sectional side view showing a state in which the recording head is fixed to the carriage by a pressing unit.

As shown in FIG. 7, in the head set lever 403, stoppers 403*d* are provided with a predetermined clearance to each of the pressing portions 403*a* on the right and left sides. Each stopper 403*d* is integrally formed by bending the sheet metals of the first side plate portion 403*l* and the second side plate portion 403*m*, which constitute the head set lever 403. The pressing portion 403*a* presses a slope portion 501*a*, which is provided in the recording head cartridge 501, by the rotation of the head set lever 403. At this point, the electric wiring board 506 is guided to an inlet port in the head connector 405 and inserted into the head connector 405. When an edge of the wiring board 506 is plunged into the contact pin 405*a* of the head connector 405, a relatively large pressing force is required. Once the edge is plunged in the contact pin 405*a*, a slide friction force acts between the contact pin 405*a* and the external input signal terminal 510 on the electric wiring board 506.

Since the pressing force in plunging the edge is much larger than the slide friction force between the contact pin 405*a* and the external input signal terminal 510, when the spring force generating the pressing force necessary to plunge the edge is set to the pressing portion 403*a*, the spring force acting on the recording head cartridge 501 becomes excessive after the recording head cartridge 501 is fixed to the carriage 401, and the overall carriage 401 may be deformed.

Therefore, when the large force in plunging the edge or the unexpected force which deflects the pressing portion 403*a* acts on the pressing portion 403*a*, the stopper 403*d* prevents the deflection and receives the large force in plunging the edge or the unexpected force. Accordingly, by the configuration in which the stopper 403*d* is included, it is not necessary to increase the spring force set in the pressing portion 403*a*, and influence of the unexpected force on the overall carriage 401 can be decreased.

Since so-called hemming bending, in which a front end of the pressing portion 403*a* is bent to about 180° is performed to the pressing portion 403*a*, when the recording head cartridge 501 presses the slope portion 501*a*, the edge of the sheet metal is not cut into the slope portion 501*a*.

Figure 9:
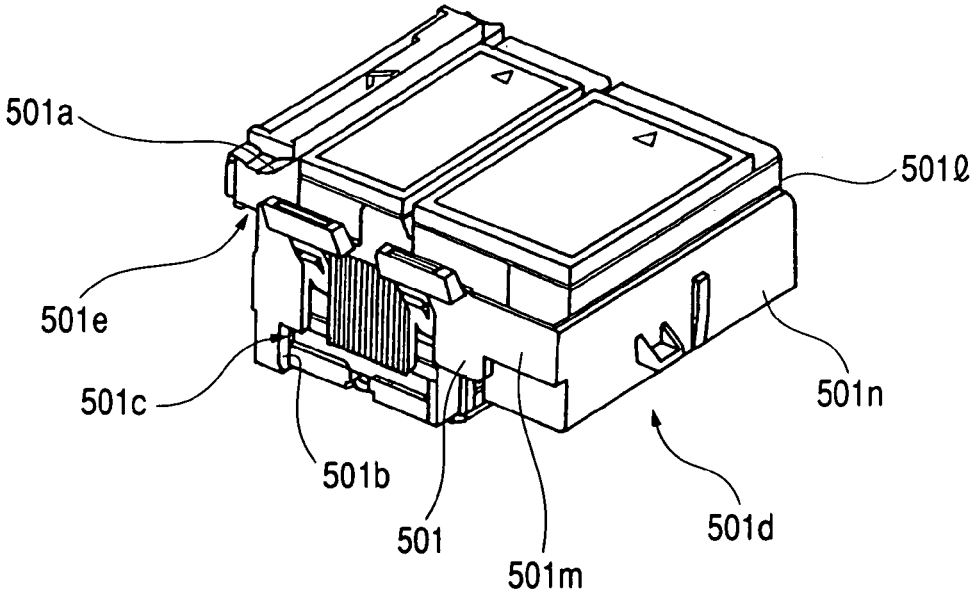
FIG. 9 is a perspective view showing the configuration of the recording head.

As shown in FIG. 7, force F acts on the slope portion 501*a* in such a manner that the front end of the pressing portion 403*a* presses the slope portion 501*a*. At this point, the slope portion 501*a* is set with a predetermined angle so that the force F can be divided into force Fy and force Fz. The force Fy causes the recording head cartridge 501 to press a Y direction locating portion 501*b* shown in FIG. 9 to a locating portion 401*d* on the carriage 401 shown in FIG. 6, and the force Fz simultaneously causes the recording head cartridge 501 to press a Z direction locating portion 501*c* to a locating portion 401*c* on the carriage 401. Accordingly, the recording head cartridge 501 is located relative to the carriage 401. A movement having a rotational center near the locating portion on the carriage 401 acts on the recording head cartridge 501 in a clockwise direction in FIG. 7, and a locating portion 501*d* provided on a bottom surface of the recording head cartridge 501 is pressed to a locating portion 401*e*. Thus, the recording head cartridge 501 is prevented from rotating, and the locating of the recording head cartridge 501 to the carriage 401 is completed.

Although the locating of the recording head cartridge 501 to the carriage 401 in the Y and Z directions was described, the locating in the X direction, i.e., the longitudinal direction of the guide shaft 402, is performed in such a manner that, before the edge of the electric wiring board 506 is plunged into the contact pin 405*a* of the head connector 405, the predetermined locating portion (not shown) of the recording head cartridge 501 is pressed to abut on the predetermined locating portion (not shown) of the carriage 401 by an X direction biasing spring 409 shown in FIG. 4. Then, the locating in the Y and Z directions is performed, and the three-directional locating is securely performed in the recording head cartridge 501.

Figure 8:
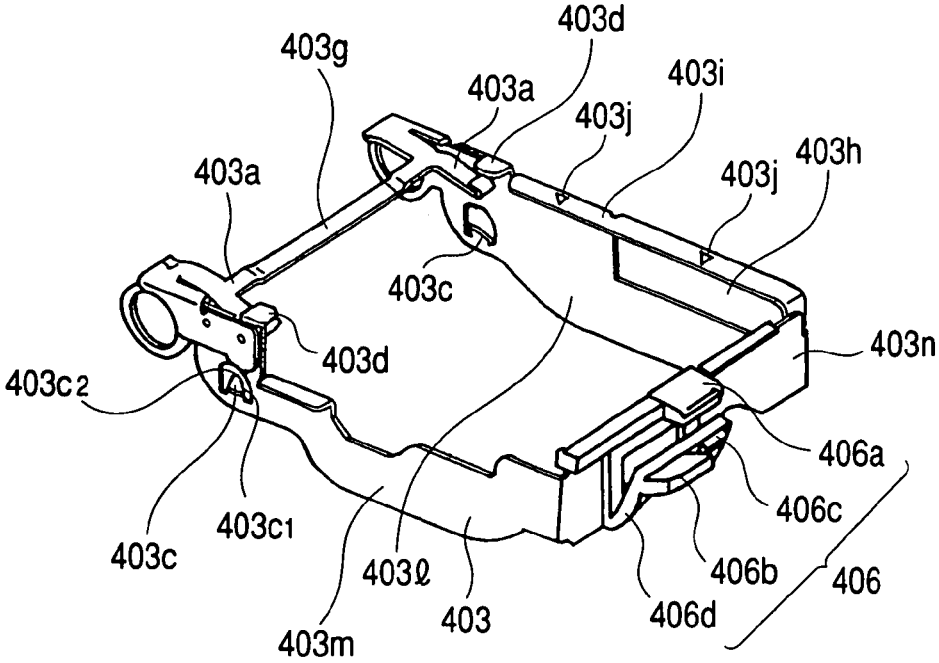
FIG. 8 is a perspective view showing the configuration of the head set lever.

In the embodiment, as shown in FIG. 8, the pressing portions 403*a* provided on the right and left sides are integrally connected by a bridge-shape portion 403*g*. This configuration can prevent the pressing force from dispersing, such that the pressing portion 403*a* falls at the position where the pressing portion 403*a* is bent at right angles from the head set lever 403.

Since the bridge-shape portion 403*g* functions as a member material, rigidity of the head set lever 403 having the U-shape is also increased, so that the more stable pressing force can be obtained.

The overall bridge-shape portion 403*g* is upwardly deflected by the force acting on the pressing portion 403*a*. When a wall of a casing or the like is provided on an upper portion of the carriage 401 with relatively narrow clearance, since the wall of the casing may be in contact with the bridge-shape portion 403*g* by the deflection, a central portion of the bridge-shape portion 403*g* is previously formed in a downwardly concave shape.

The shape of the head set lever 403 will be described in detail below.

FIG. 8 shows the head set lever 403 and the head set hook 406 provided in the head set lever 403. As described above, the U-shaped head set lever 403 includes the first side plate portion 403*l*, the second side plate portion 403*m*, and the front plate portion 403*n*. The head set lever 403 has a square shape as a whole in such a manner that the bridge-shape portion 403*g* connects the pressing portions 403*a*. The square shape of the carriage 401 has an opening which can receive the recording head cartridge 501 having the shape similar to the opening. The recording head cartridge 501 is inserted into the carriage 401 through the opening. The head set lever 403 is formed so that at least three side faces of the head set lever 403 are inserted between the carriage 401 and the recording head cartridge 501, which have the shape similar to the head set lever 403.

That is to say, in the head set lever 403, the first side plate portion 403*l* is arranged to be inserted between a surface 401*l* of the carriage 401 and a surface 501*l* of the recording head cartridge 501, the second side plate portion 403*m* is arranged to be inserted between a surface 401*m* of the carriage 401 and a surface 501*m* of the recording head cartridge 501, and the front plate portion 403*n* is arranged to be inserted between a surface 401*n* of the carriage 401 and a surface 501*n* of the recording head cartridge 501 (see FIGS. 4 to 6, FIG. 8, and FIG. 9). The above arrangement can provide the head set lever 403 with minimum space while strength of the head set lever 403 is secured. At the same time, the opening portion for mounting the ink tank 502 on the recording head cartridge 501 can be formed.

A hood portion 403*i* is provided on an upper end portion of the second side plate portion 403*m* of the head set lever 403, and an index 403*j* is provided in the hood portion 403*i*. The index 403*j* is imprinted on the hood portion 403*i*. But, a label or the like for the index 403*j* may be affixed to the hood portion 403*i*. The index 403*j* corresponds to the ink tank 502 mounted on the recording head cartridge 501; the same index is also provided on the side of the ink tank 502 (see FIG. 5). The user can mount the plurality of ink tanks on the recording head cartridge without fail by providing the indexes. Although two kinds of ink tanks, i.e., the black ink tank and the color ink tank, are mounted in the embodiment, one ink tank may be mounted, or at least three ink tanks may be mounted.

One end of the ink tank 502 is inserted under the hood portion 403*i*, and the ink tank 502 is mounted by a latch lever provided on the other end of the ink tank 502 to the recording head cartridge 501. Thus, the ink tank 502 is mounted by the rotational operation, and the hood portion 403*i* is also provided in order that the user can recognize the rotational operation.

Since the hood portion 403*i* is provided in the head set lever 403, when the head set lever 403 is released, the hood portion 403*i* is also simultaneously retracted so that the recording head cartridge 501 can be mounted without obstruction of the hood portion 403*i*. When the hood portion 403*i* is previously formed in the carriage 401, it is necessary that the recording head cartridge 501 is mounted by slipping through the hood portion 403*i*, i.e., as disclosed in Japanese Patent Application Laid-Open No. H10-181007, it is necessary that the recording head cartridge is mounted by rotating the recording head cartridge. In the method disclosed in Japanese Patent Application Laid-Open No. H10-181007, the vertical insertion type of card edge head connector in the embodiment cannot be applied. Therefore, the card edge connector can be adopted while the above-mentioned advantage of the hood portion 403*i* is obtained in such a manner that the hood portion 403*i* is provided in the head set lever 403.

An opening portion 403*h*, which is shown in FIG. 8 and formed in the first side plate portion 403*l* of the head set lever 403, prevents an edge line of the ink tank 502 from interfering with the head set lever 403. The interference between the edge line of the ink tank 502 and the head set lever 403 is caused by the rotational operation of the ink tank 502, when the ink tank 502 is mounted. At this point, whether the ink tank 502 interferes with the head set lever 403 or not is related with the arrangement of an ink connecting portion between the ink tank 502 and the recording head cartridge 501. For the ink tank arranged at the position where the interference occurs, the interference can be prevented by cutting the recording head cartridge 501 to provide the opening.

The head set hook 406 is provided in the front plate portion 403*n* which is the surface opposite to the rotational center of the head set lever 403. The head set hook 406 in made of resin. A first operating portion 406*a*, a second operating portion 406*b*, and the latch click 406*c* are integrally molded in the head set hook 406, and the head set hook 406 is press-fitted into the front plate portion 403*n*. The first operating portion 406*a* is fixed with the front plate portion 403*n* in unitary relation, and the second operating portion 406*b* and the latch click 406*c* are provided in a lever portion 406*d* which is elastically supported to the front plate portion 403*n*.

The first operating portion 406*a* is one which performs. operation when the recording head cartridge 501 is fixed to the carriage 401. When the user performs the operation in which the recording head cartridge 501 is fixed to the carriage 401, the user downwardly presses the first operating portion 406*a* to engage the latch click 406*c* with the latch engaging portion 401*b* of the carriage 401. Since the first operating portion 406*a* is substantially located in the center of a width direction (carriage operating direction) of the recording head cartridge 501, the head set lever 403 is not tilted during the operation of the head set lever 403. As described above, the head set lever 403 has the U-shape, and the head set lever 403 is easy to tilt when the position which is pressed is biased, so that the first operating portion 406*a* is provided in the substantial center of the width direction of the recording head cartridge 501.

The latch click 406*c* provided in the head set hook 406 is substantially located in the center of the width direction of the recording head cartridge 501 which is located at the substantially same position as the first operating portion 406*a* when viewed from the upper surface. That is to say, the portion in which the head set lever 403 engages with the carriage 401 is the substantial center of the two pressing portions 403*a*, so that the head set lever 403 is not tilted even after the head is fixed. If the head set lever 403 is tilted, the head set lever 403 may be in contact with the wall of the casing or the like, which is provided above the head set lever 403 with small clearance.

The second operating portion 406*b* is one which releases the engagement between the latch click 406*c* and the latch engaging portion 401*b* of the carriage 401. The head set lever 403 is released by releasing the latch click 406*c* from the latch engaging portion 401*b*.

In the configuration of the head set hook 406 of the embodiment, the first operating portion 406*a* is operated in order to fix the head, and the second operating portion 406*b* provided at the position different from the first operating portion 406*a* is operated in order to release the head. Accordingly, while the failure of the user can be decreased, the head fixation can be secured by separating the function of the operation. If the operating portion has both the functions of fixing and releasing the head, it is necessary that the operation in which the head is downwardly pressed to be fixed and the operation in which the head is upwardly raised to be released are performed with the same part, and it is necessary to balance head fixing force, so that the head cannot be securely fixed.

Further, since the first operating portion 406*a*, the second operating portion 406*b*, and the latch click 406*c* are integrally molded in the head set hook 406, the head set hook 406 has the extremely advantageous configuration from the point of view of cost.

The method of releasing the recording head cartridge from the head connector will be described below.

As shown in FIG. 7, FIG. 8, and FIGS. 10A to 10C, a recording head releasing portion 403*c* is formed such that the sheet metal is bent from the head set lever 403 to the inside. Each recording head releasing portion 403*c* is provided at the first side plate portion 403*l* and the second side plate portion 403*m*, which are the side face of the head set lever 403. The position where the recording head releasing portion 403*c* is provided is substantially located at the same position as the head connector when viewed from the side face. In the shape of the recording head releasing portion 403*c*, a front end 403*c*2 is formed on the side near the rotational center of the head set lever 403, and a chamfering portion 403*c*1 is formed from the front end 403*c*2 toward the direction which deviates from the rotational center of the head set lever 403.

When the recording head cartridge 501 is fixed, as described above, the recording head cartridge 501 is inserted in the opening portion of the carriage 401 and the head set lever 403 is rotated in the closing direction. The front end of the recording head releasing portion 403*c* is rotated, while the recording head releasing portion 403*c* comes into contact with the side face of the recording head cartridge 501 and the recording head releasing portion 403*c* is slightly deflected toward the side face of the head set lever 403. At this point, the recording head releasing portion 403*c* comes into contact with the side face of the recording head cartridge 501. However, the recording head releasing portion 403*c* does not move the recording head cartridge 501 by engaging the recording head cartridge 501. At the time when the pressing portion. 403*a* presses the recording head cartridge 501 and the recording head cartridge 501 is fixed, the recording head, releasing portion 403*c* does not obstruct the locating of the recording head cartridge 501, because the recording head releasing portion 403*c* has a predetermined clearance l between recording head releasing portion 403*c* and the recording head cartridge 501 as shown in FIG. 11A, and thus the recording head releasing portion 403*c* does not come into contact with the recording head cartridge 501. At this point, the recording head releasing portion 403*c* is located under an engaging portion 501*e* of the recording head cartridge 501.

Figure 10A:
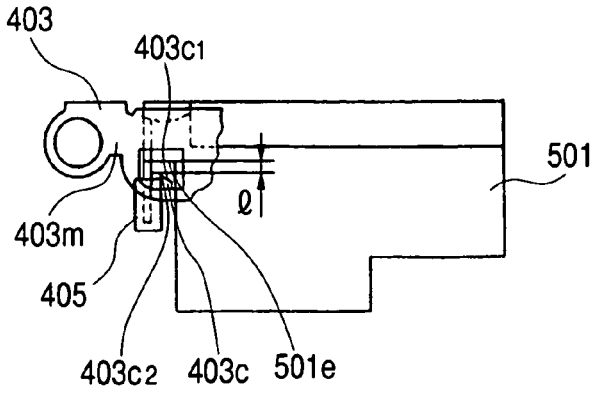
FIGS. 10A, 10B, and 10C are perspective views illustrating a releasing operation of the recording head.
Figure 10B:
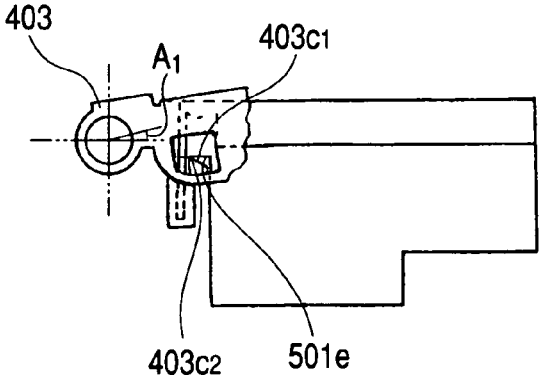
Figure 10C:
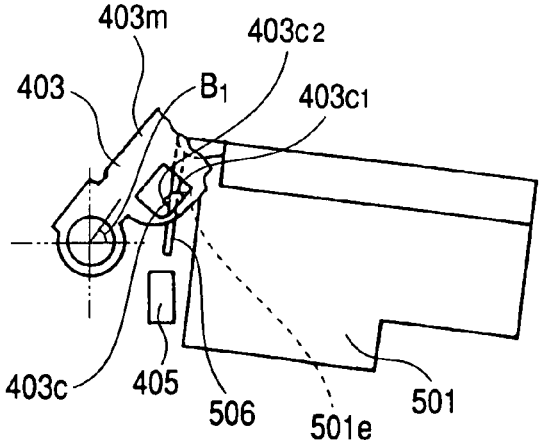

When the fixation of the head set lever 403 is released and rotated from the above-mentioned state by operating the head set hook 406, as shown in FIG. 10B, after the end 403*c*2 of the recording head releasing portion 403*c* rotates by the predetermined clearance 1, the front end 403*c*2 of the recording head releasing portion 403*c* engages with the engaging portion 501*e* of the recording head cartridge 501 at a predetermined rotational angle A1 and upwardly raises the recording head cartridge 501. When the head set lever 403 is further rotated, the electric wiring board 506 is released from the head set lever 403 while the front end 403*c*2 engages the engaging portion 501*e*. Then, when the head set lever 403 is further rotated as shown in FIG. 10C, the recording head cartridge 501 is separated from the head connector 506. That is to say, the recording head cartridge 501 is separated from the head connector 506 in such a manner that the engagement between the front end 403*c*2 and the engaging portion 501*e* is released by rotating the head set lever 403 up to a predetermined rotational angle B1. At this state, the recording head cartridge 501 is free from the carriage 401, and the user can remove the recording head cartridge 501 from the carriage 401.

The recording head releasing portion 403*c* has the predetermined width, because the strength is required. The chambering portion 403*c*1 is formed on one side of the recording head releasing portion 403*c*, and the recording head releasing portion 403*c* engages the recording head cartridge 501 at the front end 403*c*2 which is the point on the side nearer the rotational center of the head set lever 403, so that the recording head releasing portion 403*c* is rapidly retracted from the recording head cartridge 501 after the engagement between the recording head cartridge 501 and the carriage 401 is released.

The recording head releasing portion 403*c* is located near both ends of the head corrector 506 and also located near the rotational center of the head set lever 403, so that the user need apply only a small operating force and can obtain a very comfortable operating feel.

Although the recording head releasing portion 403*c* and the head set lever 403 are integrally formed, the recording head releasing portion 403*c* and the head set lever 403 may be also separately formed. In this case, the configuration which is easy to deflect can be taken on the side of the side face of the head set lever, in order to relieve contact wear between the recording head releasing portion 403*c* and the side face of the recording head cartridge when the head set lever is set.

As described above, according to each embodiment of the invention, the electrical connection between the card edge connector and the connecting portion on the head side can be secured by the operation of the lever member with the light force, so that the miniaturized carriage can be formed while the card edge connector is used, the head fixation and the head release can be stably realized, and the miniaturization of the recording apparatus can be realized.

What is claimed is:

1. A recording apparatus comprising:

a carriage which detachably mounts a recording head including a head side connecting portion to which electric power for driving the recording head and a signal are transmitted, the carriage including a card edge connector where the head side connecting portion is inserted for electric connection when the recording head is mounted;

a guide shaft which guides the carriage in a predetermined scanning direction;

a lever member which is arranged in the carriage, the lever member inserting the recording head into the carriage and detaching the recording head from the carriage, by rotation of the lever member about the guide shaft; and a pressing portion which is arranged in the lever member, the pressing portion pressing the recording head in a direction in which the head side connecting portion is inserted into the card edge connector, wherein the pressing portion is arranged near a rotational center of the lever member.

2. A recording apparatus according to claim 1, wherein the pressing portion comprises a stopper portion which controls displacement of the pressing portion, the stopper portion having a predetermined clearance in a direction of displacement made when the pressing portion presses the recording head.

3. A recording apparatus according to claim 1, wherein, in the recording head, a pressed portion which is pressed by the pressing portion forms a predetermined angle relative to a direction in which the head side connecting portion is inserted into the card edge connector, and the recording head is located in a first direction and a second direction relative to the carriage by a pressing force of the pressing portion.

4. A recording apparatus according to claim 1, wherein the lever member is made of sheet metal, and the pressing portion is formed by a plate spring which generates the pressing force by deflection of the sheet metal.

5. A recording apparatus according to claim 4, wherein the recording head pressing portion is made of the sheet metal and integrated with the lever member, and the recording head is pressed by a substantially 180°-bent portion which is arranged at a front end of the pressing portion.

6. A recording apparatus according to claim 4, wherein at least two pressing portions are provided at positions in which the pressing portions press a place near both sides of the head side connecting portion.

7. A recording apparatus according to claim 6, wherein the two pressing portions are integrally connected to each other.

* * * * *